US007883762B2

(12) United States Patent
Doublet

(10) Patent No.: US 7,883,762 B2
(45) **Date of Patent: *Feb. 8, 2011**

(54) DOUBLE SIDED PRINTED SECURITY DOCUMENT

(75) Inventor: Pierre Doublet, Saint-Brice (FR)

(73) Assignee: Arjowiggins Security, Paris (FR)

( * ) Notice: Subject to any disclaimer, the term of this patent is extended or adjusted under 35 U.S.C. 154(b) by 579 days.

This patent is subject to a terminal disclaimer.

(21) Appl. No.: 10/521,555

(22) PCT Filed: Jul. 18, 2003

(86) PCT No.: PCT/FR03/02273

§ 371 (c)(1),
(2), (4) Date: Jan. 19, 2005

(87) PCT Pub. No.: WO2004/009372

PCT Pub. Date: Jan. 29, 2004

(65) Prior Publication Data

US 2005/0244720 A1 Nov. 3, 2005

(30) Foreign Application Priority Data

Jul. 19, 2002 (FR) ..... 02 09221

(51) Int. Cl.
*B41M 5/00* (2006.01)

(52) U.S. Cl. ..... 428/195.1; 428/917; 428/916; 283/72; 283/57; 283/77; 283/91; 283/92; 283/93; 283/94; 283/58; 430/10; 430/301; 430/302; 430/303; 430/304; 430/305; 430/306; 430/307; 430/308; 358/405; 358/374; 358/454; 358/533; 356/604; 356/608; 356/636

(58) Field of Classification Search ..... 428/195.1, 428/917, 916; 283/67, 72, 57, 77, 91–94, 283/58; 430/10, 301–308; 358/405, 374, 358/454, 533; 356/604, 608, 636
See application file for complete search history.

(56) References Cited

U.S. PATENT DOCUMENTS

| | | | | |
|---|---|---|---|---|
| 5,449,200 | A * | 9/1995 | Andric et al. | 283/67 |
| 5,735,547 | A * | 4/1998 | Morelle et al. | 283/67 |
| 5,857,709 | A * | 1/1999 | Chock | 283/86 |
| 5,904,375 | A * | 5/1999 | Brugada | 283/85 |
| 6,089,614 | A | 7/2000 | Howland et al. | |
| 6,183,018 | B1 * | 2/2001 | Braun et al. | 283/114 |
| 6,357,800 | B1 * | 3/2002 | Muller et al. | 283/93 |
| 6,369,919 | B1 * | 4/2002 | Drinkwater et al. | 359/2 |
| 6,402,888 | B1 * | 6/2002 | Doublet et al. | 162/140 |

(Continued)

FOREIGN PATENT DOCUMENTS

CA 2335239 A1 * 6/2000

(Continued)

*Primary Examiner*—Bruce H. Hess
*Assistant Examiner*—Tamra L Amakwe
(74) *Attorney, Agent, or Firm*—Westerman, Hattori, Daniels & Adrian, LLP

(57) ABSTRACT

The invention concerns a security document comprising, as security element against recto/verso copying, indicia present on both sides and capable of being viewed under reflected lighting and forming an image capable of being viewed under transmitted light. The invention is characterized in that said indicia comprise lines and form said image with 3D effect.

14 Claims, 1 Drawing Sheet

U.S. PATENT DOCUMENTS

Figure 1A:
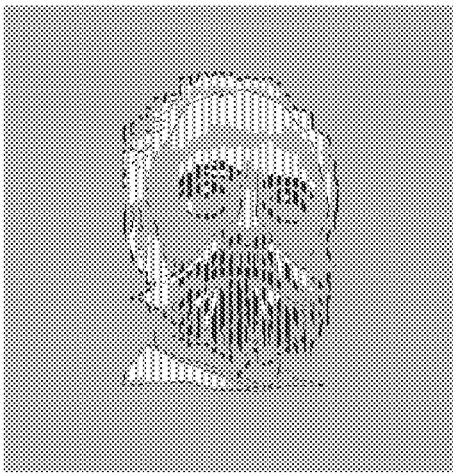
Figure 1B:
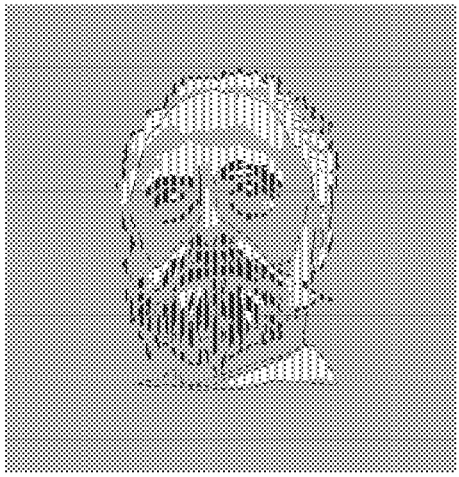
Figure 1C:
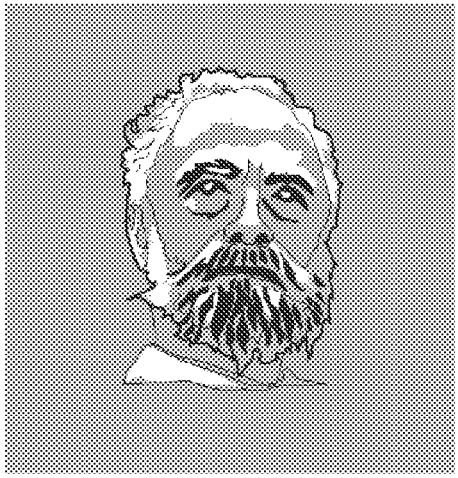

| | | | | |
|---|---|---|---|---|
| 6,471,248 | B2 * | 10/2002 | Hardwick et al. | 283/72 |
| 6,991,260 | B2 * | 1/2006 | Fan et al. | 283/72 |
| 6,991,846 | B2 * | 1/2006 | Mallol et al. | 428/292.1 |
| 7,429,062 | B2 * | 9/2008 | Fan et al. | 283/72 |
| 2001/0018113 | A1 * | 8/2001 | Mallol et al. | 428/195 |

FOREIGN PATENT DOCUMENTS

| | | |
|---|---|---|
| DE | 43 34 848 | 1/1995 |
| EP | 0 388 090 | 9/1990 |

* cited by examiner

DOUBLE SIDED PRINTED SECURITY DOCUMENT

The invention relates to a security document that includes, as copy protection element, printed lines on both sides of the document that can be observed in reflected light and form an image that can be observed in transmitted light.

To combat the counterfeiting of banknotes by two-sided photocopying or using a scanner and a printer, patterns on the front side and patterns on the reverse side of the banknote have been produced, by suitable registration in a given region, so that these patterns combine to form a final image or representation, for example a set of graphical lines or alphanumeric characters or an image of a person or animal, etc. When the banknote is viewed in reflected light, only the pattern produced on the observed face is seen whereas, when the banknote is observed in transmitted light, all the patterns that therefore combine to give the final representation are seen. According to a variant of these printed indicia, identical patterns are produced on the front side and on the reverse side by superposing them so as to observe, in transmitted light, an image that is also identical to the patterns. These patterns are produced by printing areas of flat tint or by printing lines. A person skilled in the art refers to these as "see-through" indicia or, in the case of the variant, as "print-through" indicia. Certain banknotes have a weight and an opacity that are sufficiently low to allow these patterns to be observed provided that the printed indicia are flat tints and/or not too fine.

To be able to apply these indicia to security documents having a higher weight and/or higher opacity, it has been proposed, in European patent application EP 388 090, to print these indicia in a region of reduced opacity, this region being produced specifically by a watermark obtained in a conventional manner. European patent application EP 687 324 proposes a region of reduced thickness and reduced opacity with an area of more than 0.4 $cm^2$ by providing a two-ply paper, one ply of which has a region of reduced or even zero thickness.

Moreover, the means for reproducing the patterns, such as photocopiers and scanners, allow two-sided color copying and have the capability of ever finer resolution; it is therefore endeavored to produce patterns that are more difficult to counterfeit.

However, the Applicant has found that, at the present time, indicia made from flat tints are the most widely used but also are relatively easy to produce by two-sided color photocopiers or scanners. For example, current banknotes of the new European Community currency, namely euros, have, in one of their corners, on both sides of the banknote, printed areas of flat tint with the dominant color of said banknote which indicate the value of the banknote, observable when it is held up to the light. These euro banknotes do not have a region of reduced opacity and the areas of flat tint are quite coarse and could be quite easy to reproduce.

As regards the printing of lines, the abovementioned, European patent application EP 388 090 has described the printing of concentric circles present alternately on the front side and on the reverse side of a sheet, but these circles do not have any particularity and could be quite easily counterfeited by current reproduction means.

The objective of the Applicant is to provide a security document having an enhanced level of security against two-sided copying.

The Applicant proposes to achieve this objective by providing a security document that includes, as security element against two-sided copying, printed indicia present on the front side and on the reverse side that are observable in reflected light and form an image that can be observed in transmitted light, said printed indicia comprising lines and forming said image such that it has a relief and volume effect, i.e. a three-dimensional or 3D effect.

Preferably, the final image that can be observed in transmitted light has a 3D effect obtained by variations in density expressed as number per unit area, and/or variations in printing intensity of the lines. The expression "variations in density expressed as number per unit area" should be understood to mean that the distances between the lines are varied.

Preferably, the lines are present in large number and are very fine.

According to one particular embodiment of the invention, the lines are made from broken lines, in particular discrete dots, i.e. separate dots.

One particular way of producing the lines may be to print the lines such that two adjacent lines of the image are always such that one of the lines is on one side and the next line on the other side.

More generally, another approach may be to print, by means of algorithms, series of lines on one side and their complements on the other. They may be parallel or may intersect. All the lines on the front side and the reverse side may be determined by mathematical means, encryption, etc.

According to a variant of the invention, the printed lines on the front side and on the reverse side are identical and superposed.

The image to be observed when held up to the light may be an image as such, but also part of a larger image or portrait, and in particular one already existing on the document.

More particularly, the lines are black lines and/or in various shades of gray and/or in color and/or they change appearance depending on the viewing angle or under the action of an excitation source, such as radiation, especially fluorescent, thermochromic or photochromic ones, and/or have electromagnetic properties, especially electrically conducting, magnetic or magnetic resonance properties.

The document may also include printed areas of flat tint. Of course, the security document may include other security elements, especially a security thread, flakes, iridescent printing, etc.

More particularly, the invention relates to a banknote.

Preferably, the printed indicia are produced in a region of reduced opacity.

In the case of a paper, this region of reduced opacity may be a region such as that described in patent application EP 687 324, i.e. a region of reduced thickness and reduced opacity with an area of more than 0.4 $cm^2$ obtained in a two-ply paper, one ply of which has a region of reduced or even zero thickness.

According to one particular embodiment of the invention, the document is therefore a sheet of two-ply paper, one ply of which includes a region of reduced or even zero thickness and has an area of more than 0.4 $cm^2$, this said region having the printed indicia.

According to one particular embodiment of the invention, the document may have, as backing, a plastic sheet or film whose opacity allows the printed indicia to be observed, as in the case of a paper.

Illustrative examples of a security document according to the invention will now be described.

According to a first example, the portrait of a man with a beard, limited to the central part of his face, i.e. his mouth, nose and part of the beard, is produced on a paper. Such an image is formed from lines, the number density of which is varied by varying their spacing; a set of lines is printed on the front side and the complementary set on the reverse side so as to constitute the portrait, which can be seen when held up to the light. The 3D, relief and volume, effect is therefore obtained by the variations in the number density of the lines.

These lines are printed by means of an offset printing machine used to print banknotes and documents of value. These machines can print both sides of a paper that are perfectly in registration with one another, something that an office photocopier or printer (after scanning) can achieve only with limited accuracy. The front side/reverse side printing registration of the portrait makes it possible to achieve a clear, high-quality image that can be observed when held up to the light.

If a counterfeiter attempts two-sided photocopying of this image, he will be unable to bring both sides of the photocopy to accurate registration and therefore the image will no longer be clear—there will then be a mass of lines and the image will no longer be visible when the document is held up to the light. Any unskilled person can thus easily and immediately see that the document or the banknote is counterfeit.

According to a preferred embodiment of this example, this image is produced in a region of reduced opacity. Such a region is produced, for example, like that described in patent EP 687 324.

According to a second example, a sheet of paper is printed with a grid on one side of the sheet and the same grid in correspondence on the reverse side. Since the printing on both sides is in extremely precise registration on machines dedicated to the printing of banknotes and security documents, and since the front side and reverse side grids are in superposition, the image of a single grid with a 3D effect appears when the sheet is observed held up to the light and also when observed in reflected light.

If a counterfeiter were to reproduce these grids by means of a copier or printer (after scanning), there would be a shift of a bar or part of the bars and therefore the grid resulting from the superposition of the two grids on the front side and reverse side would become a clump or even a black square, although when observed in reflected light a grid would be seen on the front side or on the reverse side. Any unskilled person may thus easily and immediately see that the document or banknote is counterfeit.

The invention claimed is:

1. A security document comprising a security element against two-sided copying, said security element comprising:

printed indicia present on the front side and on the reverse side, wherein said printed indicia comprise a first set of lines printed on the front side and a second set of lines printed on the reverse side, said first set of lines and said second set of lines being in accurate registration with each other, wherein the first set of lines is visible and the second set of lines is not visible observed in reflected light from the front side, and the second set of lines is visible and the first set of lines not visible observed in reflected light from the reverse side, wherein both the first set of lines and the second set of lines are visible observed in transmitted light from any of the front side and the reverse side, the first and second sets of lines being arranged to form an image observed in transmitted light, wherein the image includes a 3D effect that is a relief or volume effect created by the planar arrangement of the first and second sets of lines observed in accurate registration in transmitted light, whereas the 3D effect would not be present if the first and second sets of lines were not in accurate registration, wherein the first set of lines and the second set of lines complement each other to constitute the image so that the image with a 3D effect is visible observed in transmitted light but not visible observed in reflected light, so as to identify an authentic security document by the accurate registration.

2. The security document as claimed in claim 1, wherein the 3D effect is created as a result of the lines being of (i) variable number density per unit of area, (ii) variable printing intensity, or (iii) both variable number density per unit of area and variable printing intensity.

3. The security document as claimed in claim 1, wherein the printed indicia consist entirely of such lines.

4. The security document as claimed in claim 1, wherein, the lines of the image are printed such that two adjacent lines of the image are always such that one of the lines is on one side and the next line is on the reverse side.

5. The security document as claimed in claim 1, wherein the lines are represented in series, one series of lines being on the front side and its complementary series on the reverse side.

6. The document as claimed in claim 1, wherein the lines have at least one of the following properties: (i) they are black, (ii) they are in various shades of gray, (iii) they are in color, (iv) they change appearance depending on the viewing angle or under the action of an excitation source, (v) they have electromagnetic properties.

7. The document as claimed in claim 6, wherein the lines change appearance depending on the viewing angle or under the action of an excitation source which is a source of radiation.

8. The document as claimed in claim 6, wherein the lines have electromagnetic properties, and said electromagnetic properties comprise electrically conducting, magnetic or magnetic resonance properties.

9. The document as claimed in claim 7, wherein the source of radiation comprises a source of fluorescent, thermochromic or photochromic radiation.

10. The document as claimed in claim 7, wherein the source of radiation comprises a source of fluorescent, thermochromic or photochromic radiation.

11. The security document as claimed in claim 1, which comprises, as support, a paper with a region of reduced opacity and said printed indicia are present on the front side and on the reverse side in said region of reduced opacity.

12. The document as claimed in claim 1, wherein the lines have at least one of the following properties: (i) they are black, (ii) they are in various shades of gray, (iii) they are in color, (iv) they change appearance depending on the viewing angle or under the action of an excitation source, (v) they have electromagnetic properties.

13. The document as claimed in claim 12, wherein the lines change appearance depending on the viewing angle or under the action of an excitation source which is a source of radiation.

14. The document as claimed in claim 12, wherein the lines have electromagnetic properties, and said electromagnetic properties comprise electrically conducting, magnetic or magnetic resonance properties.

* * * * *